US007270046B2

(12) United States Patent
Stephenson et al.

(10) Patent No.: US 7,270,046 B2
(45) Date of Patent: Sep. 18, 2007

(54) INTEGRATED VALVE ASSEMBLY AND COMPUTER CONTROLLER FOR A DISTRIBUTED HYDRAULIC CONTROL SYSTEM

(75) Inventors: Dwight B. Stephenson, Oconomowoc, WI (US); Michael J. Paik, Delafield, WI (US); Peter A. Jahnke, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 147 days.

(21) Appl. No.: 11/299,937

(22) Filed: Dec. 12, 2005

(65) Prior Publication Data

US 2007/0130935 A1 Jun. 14, 2007

(51) Int. Cl.
*F15B 13/04* (2006.01)

(52) U.S. Cl. ..... 91/454; 137/596.16; 137/596.18

(58) Field of Classification Search ..... 91/454, 91/462; 137/596.13, 596.16, 596.18
See application file for complete search history.

(56) References Cited

U.S. PATENT DOCUMENTS

| | | | |
|---|---|---|---|
| 4,357,955 | A | 11/1982 | Sauer |
| 4,941,508 | A | 7/1990 | Hennessy et al. |
| 5,056,561 | A | 10/1991 | Byers |
| 5,715,865 | A | 2/1998 | Wilke |
| 5,752,426 | A | 5/1998 | Ikei et al. |
| 6,186,172 | B1 | 2/2001 | Yoshida |
| 6,408,876 | B1 | 6/2002 | Nishimura et al. |
| 6,505,645 | B1 | 1/2003 | Pack et al. |
| 6,775,974 | B2 | 8/2004 | Tabor |
| 2005/0211320 | A1 | 9/2005 | Greenwood |

FOREIGN PATENT DOCUMENTS

| | | | |
|---|---|---|---|
| DE | 4431103 | A1 | 3/1996 |
| DE | 10208390 | A1 | 5/2003 |
| EP | 0 240 965 | A1 | 10/1987 |
| WO | 2004/090340 | A1 | 10/2004 |

*Primary Examiner*—Michael Leslie
(74) *Attorney, Agent, or Firm*—Quarles & Brady; George E. Haas

(57) ABSTRACT

A distributed hydraulic system locates a control assembly, that has electrohydraulic valves and a electronic controller, adjacent the respective hydraulically powered actuator controlled by that assembly. The control assembly includes a manifold block with ports to that the pump, tank return and actuator fluid conduits connect. One or more pressure ports are provided on the manifold block at which to sense pressure at different locations therein. A controller housing, in addition to containing an electronic function controller, also contains a separate pressure sensor for each pressure port, and is mounted against the manifold block so that each pressure sensor connects to a pressure port. The manifold block also has a pair of exterior walls that extend on opposites sides of the controller housing to protect the electronic controller. Other features that facilitate distributing the hydraulic control adjacent the actuators are provided.

24 Claims, 3 Drawing Sheets

INTEGRATED VALVE ASSEMBLY AND COMPUTER CONTROLLER FOR A DISTRIBUTED HYDRAULIC CONTROL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a hydraulic system having valves that are operated to control the flow of fluid to hydraulic actuators that move components on a machine, and more particularly to distributed control systems in which the valves are located adjacent the associated hydraulic actuator being controlled.

2. Description of the Related Art

A wide variety of machines are operated by hydraulic systems. For example, a backhoe is a common type of earth moving equipment that has a bucket rotatably attached to the end of an arm that in turn is pivotally coupled by a boom to a tractor. A hydraulic boom cylinder raises and lowers the boom with respect to the tractor and a hydraulic arm cylinder pivots the arm about the end of the boom. The bucket is rotated at the remote end of the arm by a hydraulic bucket cylinder.

Traditionally, the boom assembly was controlled by valves located near the cab of the tractor and mechanically connected to levers which the operator manipulated to independently move the boom, arm and bucket. A separate valve assembly was provided for each cylinder on the boom assembly. Operating one of the valve assemblies permitted pressurized hydraulic fluid to flow from a pump on the tractor to the associated cylinder and other fluid to return from that cylinder back to the tank on the tractor. A separate pair of hydraulic conduits ran from each valve assembly adjacent the operator cab along the boom assembly to the associated cylinder.

There has been a recent trend away from mechanically operated valves to electrohydraulic valves that are operated by electrical signals. Initially, all of the electrohydraulic valves were mounted on a single manifold block, such as the one described in U.S. Pat. No. 6,505,645, that was centrally located on the machine. Pairs of hydraulic conduits ran from that common manifold block to each hydraulic actuator on the machine. The use of electrohydraulic valves eventually evolved to the development of a distributed hydraulic system in which the valve assembly is collocated with the associated hydraulic actuator, such as a cylinder. With this type of system, the operator in the tractor cab manipulates joysticks or other input devices to generate electrical control signals for operating the valve assemblies. Because each valve assembly is adjacent the respective hydraulic actuator, the amount of plumbing on the machine is reduced. Now only a pair of conduits, a supply conduit and a tank return conduit, extends along the boom assembly to power the cylinders for the boom, arm and bucket on a backhoe, for example. Electrical cables run from a central electronic controller for the machine to the valves on the assemblies near the hydraulic actuators.

Other types of equipment also incorporate such distributed hydraulic systems.

SUMMARY OF THE INVENTION

A distributed control assembly for operating a hydraulically powered actuator includes a manifold block on which a housing for an electronic controller is mounted. The manifold block has a first supply port for connection to a source of pressurized fluid such as a pump, a first return port for connection to a fluid reservoir, and first and second workports for connection to the hydraulically powered actuator. The manifold block also has a plurality of bores each for receiving a valve to control flow of fluid among the first and second workports, the first supply port and the first return port. A separate one of a plurality of electrohydraulic valves is received in one of the plurality of bores of the manifold block and is electrically controlled by the electronic controller.

One aspect of the distributed control assembly relates to providing one or more pressure ports at which to sense pressure at different locations within the manifold block. The controller housing, in addition to containing an electronic function controller, also contains a separate pressure sensor for each pressure port of the manifold block. The controller housing is mounted against the manifold block so that each pressure sensor is connected to one of the pressure ports.

Another aspect of the distributed control assembly relates to the manifold block including a pair of exterior walls that extend on opposites sides of the controller housing. The wall protect the controller housing and its contents from damage that could result from objects striking the machine on which the distributed control assembly is mounted.

A further aspect of the distributed control assembly relates to providing additional ports on the manifold block. In one embodiment, a second supply port is connected to the first supply port, and a second return port is connected to the first return port, thereby facilitating the connection of a plurality of distributed control assemblies in a daisy chain manner. Another embodiment provides ports for various pressure relief valves, an inlet check valve, and an optional manual emergency valve.

DETAILED DESCRIPTION OF THE INVENTION

Figure 1:
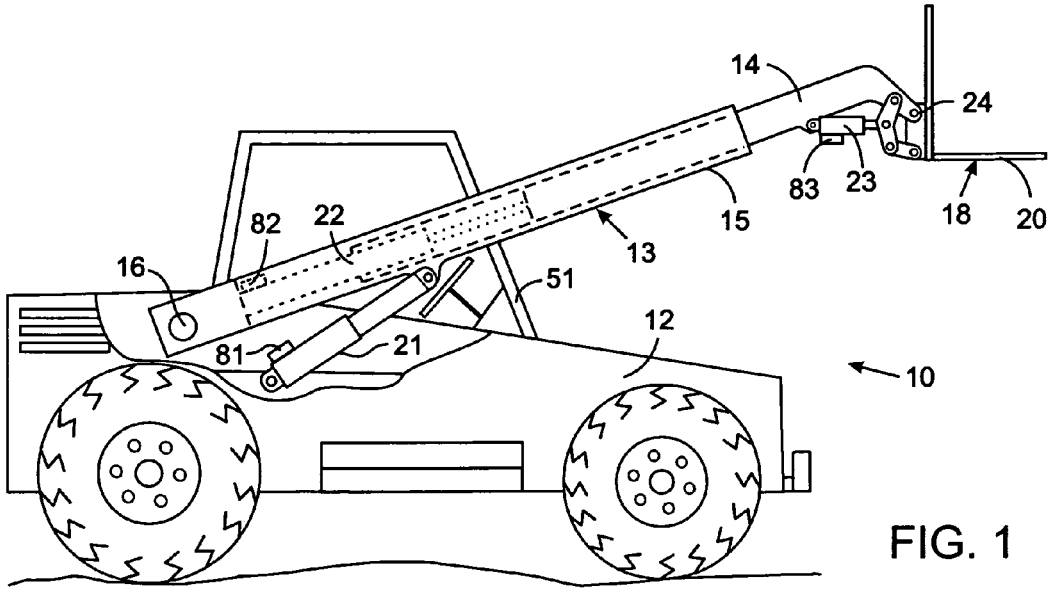
FIG. 1 is a side view of a telehandler incorporating the present invention.

With initial reference to FIG. 1, the present invention is incorporated on a telehandler 10 that comprises a tractor 12 on which a boom 13 is pivotally mounted, however, the novel concept of the invention can be used on other types of hydraulically operated equipment. A first hydraulic actuator, such as a lift cylinder 21, raises and lowers the boom 13 in an arc about a pivot shaft 16 of the tractor 12. The boom 13 comprises first and second sections 14 and 15 that can be extended and retracted telescopically in response to operation of another hydraulic actuator, such as a length cylinder 22 connected between the first and second sections within the boom. The telescopic action changes the overall length of the boom.

A workhead 18, such a pair of pallet forks 20 or a platform for lifting items, is attached at pivot point 24 to the remote end of the first boom section 14. Other types of workheads may be attached to the first boom section 14. A third hydraulic cylinder 23 rotates the workhead 18 vertically at the end of the boom 13. Extension of a piston rod from the third, or workhead, hydraulic cylinder 23 tilts the tips of the pallet forks 20 upward, and retraction of that piston rod lowers the fork tips.

Figure 2:
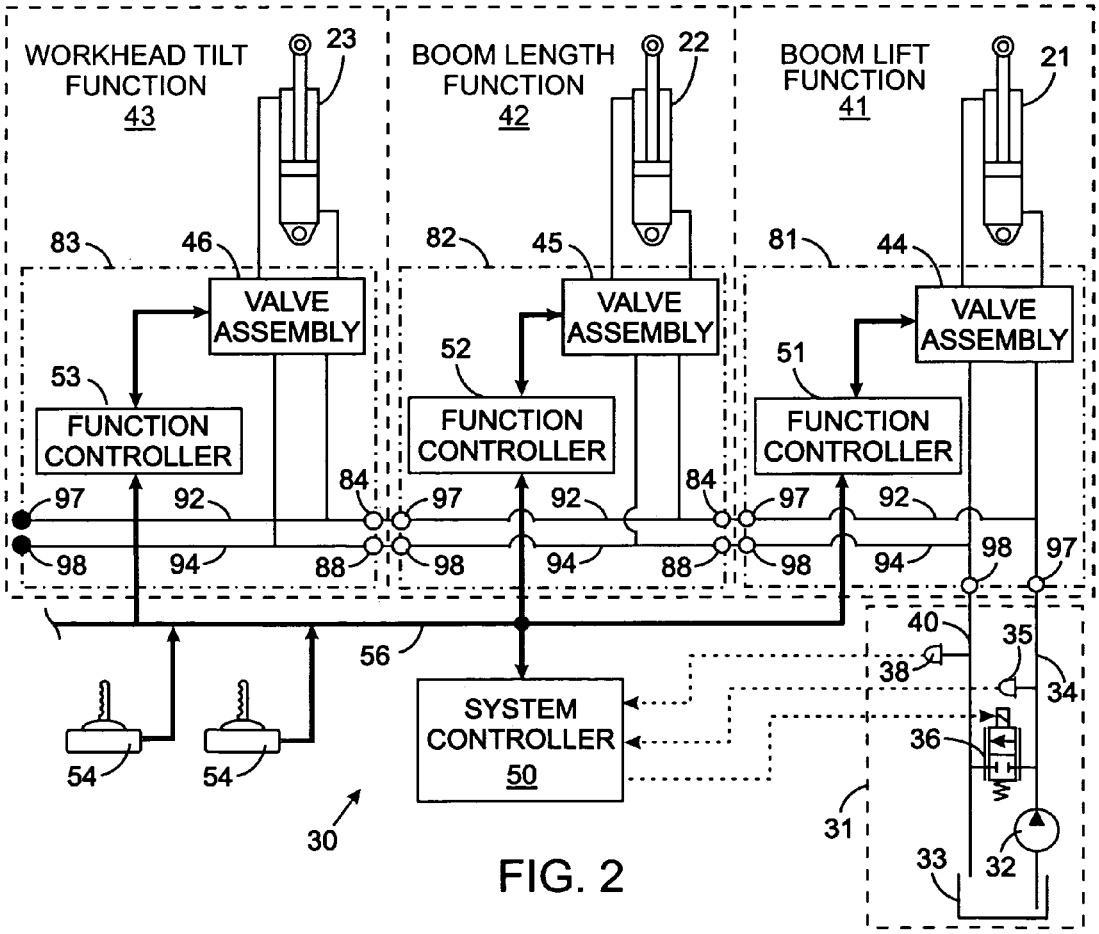
FIG. 2 is a schematic diagram of a hydraulic system for moving a boom, and tilting a workhead of the telehandler.

Referring to FIG. 2, a hydraulic system 30, for controlling operation of the telehandler boom 13, includes a fluid source 31 that has a fixed displacement pump 32 which draws fluid from a tank 33 and forces that fluid under pressure into a supply conduit 34. The supply conduit 34 furnishes pressurized fluid to a boom lift hydraulic function 41, an boom length hydraulic function 42, and a workhead hydraulic function 43, which respectively operate the boom lift cylinder 21, the boom length cylinder 22 and the workhead cylinder 23. Fluid returns from these three functions 41-43 to the tank 33 via a return conduit 40. The supply conduit 34 and the return conduit 40 extend from the pump and tank 32 and 33 located in the tractor 12 of the telehandler 10 along the boom 13. Other hydraulic functions also can be connected to the supply and return conduits 34 and 40.

The outlet pressure from the pump 32 is measured by a first sensor 35, which provides a signal indicating that pressure to a system controller 50. An unloader valve 36 is operated by the system controller 50 to regulate pressure in the supply conduit 34 by releasing some of the fluid into the tank 33. Other hydraulic systems utilize a variable displacement pump, which is be operated by the system controller 50. The system controller 50 also receives a signal from a second pressure sensor 38 that measures the pressure in the tank return conduit 40. In the preferred embodiment of the distributed hydraulic system, the system controller 50 is located in or near the operator cab 49 of the tractor 12 and receives control signals via a conventional communication network 56 from joysticks 54 that are manipulated by the telehandler operator.

Figure 3:
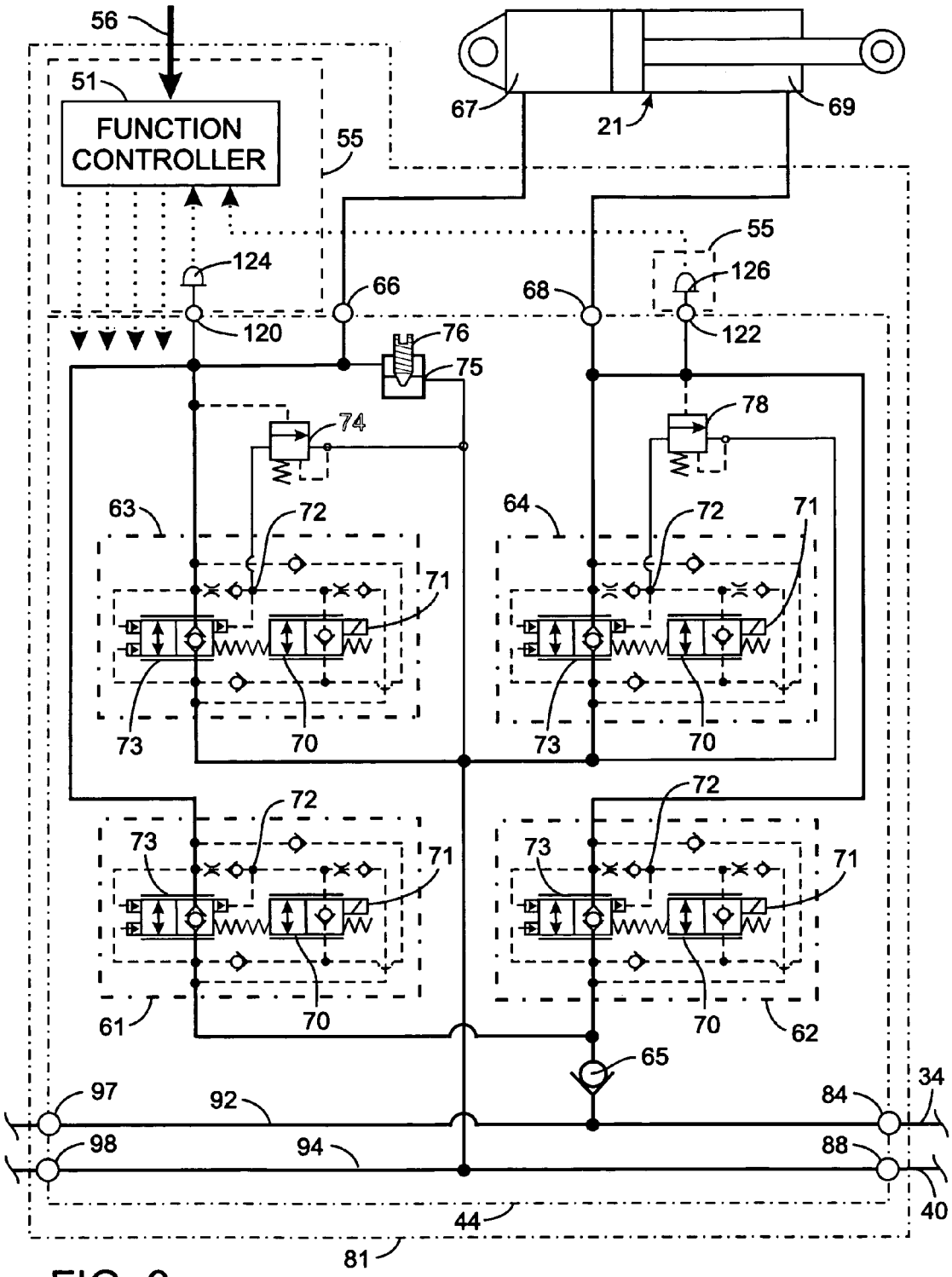
FIG. 3 is a detailed schematic diagram of one of the hydraulic functions in FIG. 2.

Each hydraulic function 41-43 includes one of the hydraulic cylinders, a valve assembly, and an electronic function controller adjacent each other at various locations on the telehandler 10. Specifically, the boom lift function 41 has a first valve assembly 44 that selectively applies the pressurized fluid from the supply conduit 34 to one of the chambers of the boom lift cylinder 21 and drains fluid from the other cylinder chamber to the return conduit 40. A second valve assembly 45 in the boom length hydraulic function 42 controls the flow of hydraulic fluid to and from the boom length cylinder 22 and the supply and return conduits 34 and 40. The workhead hydraulic function 43 has a third valve assembly 46 that couples the chambers of the workhead cylinder 23 to the supply and tank conduits 34 and 40. The valve assemblies 44, 45 and 46 are respectively operated by electrical signals from a function controller 51, 52 and 53 for the hydraulic function. The system controller 50, function controllers 51-53, and the joysticks 54 exchange operational commands, control signals and data over a communication network 56, such as the Controller Area Network serial bus that uses the communication protocol defined by ISO 11898 promulgated by the International Organization for Standardization in Geneva, Switzerland, for example. The communication network 56 also carries other messages between the engine, transmission, and other components and computers on the vehicle FIG. 3 illustrates details of the boom lift function 41 with the other hydraulic functions having an identical or substantially identical configuration. The valve assembly 44 comprises four electrohydraulic pilot operated, proportional valves 61, 62, 63 and 64, such as the one described in U.S. Pat. No. 6,745,992. The four electrohydraulic valves 61-64 are connected in a Wheatstone bridge configuration in which valves in opposite legs of the bridge (e.g. valves 61 and 64 or valves 62 and 63) are opened to extend or retract the piston rod with respect to the boom lift cylinder 21. Specifically, the supply conduit 34 is coupled by an inlet check valve 65 to the first electrohydraulic valve 61 coupled to a first workport 66 connected to the head chamber 67 of the cylinder 21. The second electrohydraulic valve 62 controls the flow of fluid from inlet check valve 65 to a second workport 68 that is connected to the rod chamber 69 of the cylinder 21. The third and fourth electrohydraulic valves 63 and 64 respectively control the fluid flow between the two workports 66 and 68 and the tank return conduit 40.

Each of these electrohydraulic valves 61-64 has a pilot valve 70 that is controlled by solenoid operator 71 which is activated by a signal from the function controller 51. The pilot valve 70 controls the pressure in a control chamber 72 of the respective electrohydraulic valve which pressure in turn controls movement of the main valve element 73 that governs the fluid flow through the electrohydraulic valve.

A first pressure relief valve 74 responds to pressure at the first workport 66 exceeding a predefined level by opening a path from the control chamber 72 of the third electrohydraulic valve 63 to the tank return conduit 40. This action releases the pressure in that control chamber, thereby allowing the workport pressure acting on the third electrohydraulic valve's main valve element 73 to open that valve. This combined action of a pressure relief valve and a main valve element creates a path from the first workport 66 to the tank return conduit 40 while releasing the excessive workport pressure. Because the first pressure relief valve 74 handles only minimal fluid flow from the control chamber 72, it can be smaller that a conventional relief valve through which fluid from the workport would flow due to an excessive pressure condition.

A second pressure relief valve 78 responds to pressure at the second workport 68 exceeding a predefined level by opening a path from the control chamber 72 of the fourth electrohydraulic valve 64 to the tank return conduit 40. That action provides a path through the fourth electrohydraulic valve 64 that releases the pressure at the second workport 68 into the tank return conduit 40. Here too, the combination of a relatively small pressure relief valve and a main valve element provide the workport pressure relief function.

A manually operated emergency valve 75 provides a controllable path between the first workport 66 and the tank return conduit 40. The emergency valve 75 is operated by turning a screwdriver that engages a threaded valve element 76. In the event that power driving the pump 32 is lost, opening the emergency valve 75 releases fluid from the head chamber 67 of the boom lift cylinder 21 which lowers the boom 13.

Referring again to FIG. 2, operation of the three valve assemblies 44, 45 and 46 is controlled by a separate function controller 51, 52 and 53, respectively, which is collocated with the associated valve assembly along the boom 13. The combination of a valve assembly 44, 45 or 46 with a function controller 51, 52 or 53 forms a distributed control assembly 81, 82 and 83 for the associated hydraulic function 41, 42 or 43. The three distributed control assemblies have identical construction with the one 81 for the boom lift function 41 being shown in FIGS. 4 and 5.

The first distributed control assembly 81 has a manifold block 80 with a first end face 84 and an opposite second end face 86. The first end face 84 has a first supply port 87 and a first return port 88 therein, and the second end face 86 has a second supply port 90 and a second return port 91. A supply passage 92 directly connects the first and second supply ports 87 and 90. Similarly, a return passage 94 directly connects the first and second return ports 88 and 91 through the manifold block 80. The terms "directly connects" and "directly connected ", as used herein, mean that the associated components are connected together by a conduit without any intervening element, such as a valve, an orifice or other device, which restricts or controls the flow of fluid beyond the inherent restriction of any conduit. As seen in FIG. 2, the pump supply conduit 34 has segments in which hoses connect each distributed control assembly 81-82 in a daisy chain manner. A similar daisy chain connection occurs for the return conduit 40 in which hoses are connected to the first and second return ports 88 and 91.

A first workport 66 also is located on the first end face 84, while the second workport 68 is on the second end face 86. The first end face 84 of the manifold block 80 has a first valve bore 95, within which the first electrohydraulic valve 61 is received. The manifold block 80 has internal passages that connect the first valve bore 95 with the supply passage 92 and the first workport 66 so that the first electrohydraulic valve 61 can control the fluid flow there between as depicted in FIG. 3. A second valve bore 96 is provided in the first end face 84 to receive the third electrohydraulic valve 93 and additional passages extend in the manifold block 80 between the second valve bore and both the return passage 94 and the first workport 66.

Figure 5:
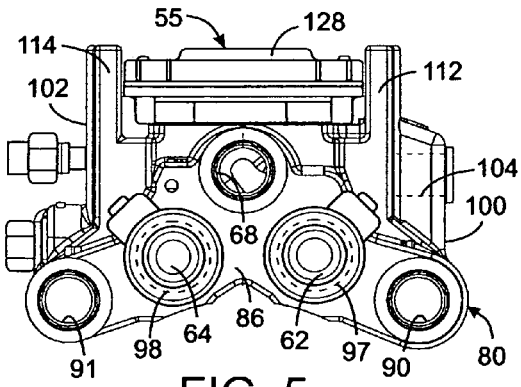
FIG. 5 is an elevational view of the far end of the distributed control assembly in FIG. 4 with the related valves removed.

Similarly, the second end face 86, as shown in FIG. 5, has a third valve bore 97 therein within which the second electrohydraulic valve 62 is received in the completed assembly. Internal passages from the supply passage 92 and the second workport 68 open into the third valve bore 97. A fourth valve bore 98 also is located in the second end face 86 with passages opening into that bore that provide paths from the tank return passage 94 and the second workport 68.

Referring again to both FIGS. 4 and 5, the manifold block 80 has opposite first and second side faces 100 and 102 which extend between the two end faces 84 and 86. The first side face 100 has an aperture 104 which communicates with the supply passage 92 and the first and third valve bores 95 and 97. The aperture 104 in the first side face 100 receives the inlet check valve 65. The second side face 102 has first and second apertures 106 and 108 that are respectively connected to the first and second workports 66 and the bores for the third and fourth electrohydraulic valves 63 and 64. This pair of apertures 106 and 108 respectively receive the first and second pressure relief valves 74 and 78. A third aperture 110 is located within the second side face 102 and has passages opening therein which lead to the first workport 66 and the return passage 94. The manually operated emergency valve 75 is received within that third aperture 110.

The first and second side faces 100 and 102 each include an upstanding wall 112 and 114, respectively, that are spaced apart forming a cavity 116 on the exterior of the manifold block 80. The cavity 116 has a flat bottom surface 118 through which a pair of pressure ports 120 and 122 extends. As shown in FIG. 3, the first pressure port 120 communicates with the first workport 66, while the second pressure port 122 communicates with the second workport 68. The figure also shows that a first function pressure sensor 124 is connected to the first pressure port 120 and a second function pressure sensor 126 is connected to the second pressure port 122.

Figure 4:
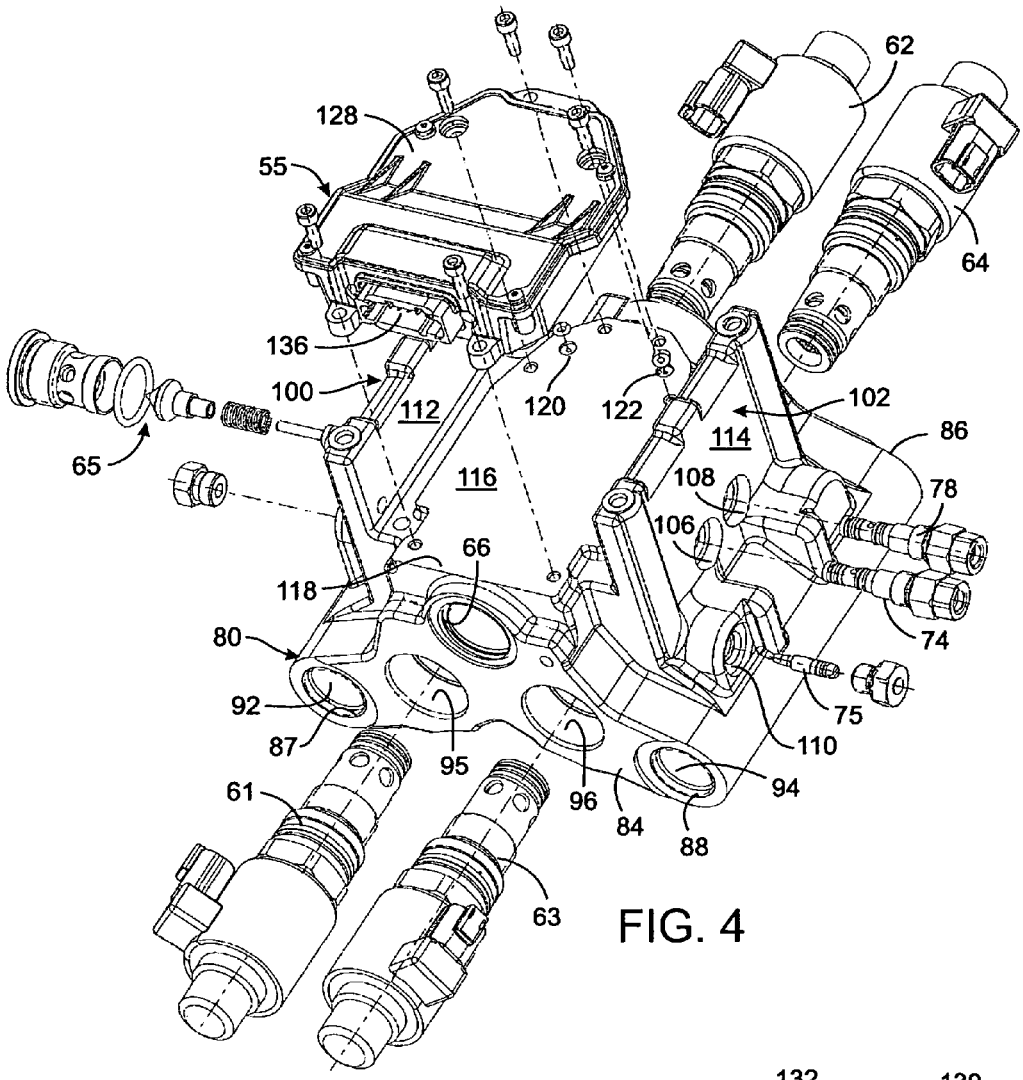
FIG. 4 is an exploded view of a distributed control assembly that operates each cylinder and piston arrangement in the hydraulic system.

The first and second function pressure sensors 124 and 126 and the function controller 51 are enclosed within a controller housing 128, thereby forming a controller assembly 55 that is illustrated in FIGS. 4 and 5. The controller housing 128 has an electrical connector 136 which receives a mating connector that is connected to the communication link 58 and to conductors leading to the solenoid operators 71 of the four electrohydraulic valves 61-64. The controller housing 128 fits between the two walls 112 and 114 of the manifold block 80 and is bolted against the surface 118 of the cavity 116. The two exterior walls 112 and 114 of the manifold block 80 extend above the upper surface of the controller housing 128. Thus, the two walls 112 and 114 protect the function controller 51 from being struck by objects in the vicinity of the hydraulic actuator on the machine.

Figure 6:
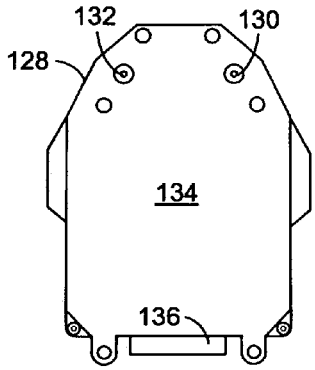
FIG. 6 is a bottom view of the controller housing of the distributed control assembly.

A printed circuit board within the housing 128 contains the electronic circuitry of the function controller 51 and the two pressure sensors 124 and 126. With additional reference to FIG. 6, the bottom surface 134 of the controller housing 128 has apertures 130 and 132 which respectively align with the first and second pressure ports 120 and 122 on the manifold block 80. That alignment applies the pressure from the two workports 66 and 68 to the first and second pressure sensors 124 and 126 within the controller housing 128. O-rings or other seals are located around the first and second pressure ports 120 and 122 to provide a fluid tight seal between the manifold block 80 and the controller housing 128 of the controller assembly 55.

U.S. Pat. No. 6,718,759 describes a velocity based system for controlling a hydraulic system, such as that shown in FIG. 2. The system controller 50 and the function controllers 51-53 incorporate microcomputers that execute software programs which perform specific tasks assigned to the respective controller. The system controller 50 supervises the overall operation of the hydraulic system 30. To produce movement of a given hydraulic cylinder 21-23 on the boom 13, the telehandler operator manipulates the corresponding joystick 54 to produce a signal that indicates the movement desired. Each joystick 54 has circuitry that transmits signals via the communication network 56 to the function controller 51, 52 or 53 that operates the respective hydraulic cylinder 21, 22 or 23. The joystick signals also are received by the system controller 50.

Each function controller 51, 52 and 53 converts a joystick signal intended for it in to a velocity command specifying the desired direction and speed that the associated hydrolic cylinder is to move. That velocity command and pressures sensed at the workport ports of the associated valve assembly 44-46 are used to determine which of the four electrohydraulic valves 61-64 to open in order to produce the desired motion of hydraulic cylinder. Then drive signals for operating the designated valves are generated and applied to the solenoid operators of those valves.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A distributed control assembly for operating a hydraulically powered actuator, said distributed control assembly comprising:

a manifold block having a first supply port for connection to a source of pressurized fluid, a first return port for connection to a fluid reservoir, and having first and second workports for connection to the hydraulically powered actuator, the manifold block including a first pressure port and a plurality of bores each for receiving a valve to control flow of fluid among the first and second workports, the first supply port and the first return port;

a plurality of electrohydraulic valves, each being received in one of the plurality of bores of the manifold block; and a controller housing containing an electronic function controller and a first pressure sensor, the controller housing being mounted against the manifold block wherein the first pressure sensor is connected to the first pressure port of the manifold block.

2. The distributed control assembly as recited in claim 1 wherein the controller housing has an aperture through which pressure is communicated from the first pressure port to the first pressure sensor.

3. The distributed control assembly as recited in claim 1 wherein the manifold block further comprises a passage connecting the first pressure port to the first workport, and a second pressure port that is connected by another passage to the second workport; and the controller housing further contains a second pressure sensor is connected to the second pressure port.

4. The distributed control assembly as recited in claim 1 wherein the manifold block further comprises opposing first and second end faces, and the first supply port and first return port are located at the first end face.

5. The distributed control assembly as recited in claim 4 wherein the first workport is located at the first end face of the manifold block, and the second workport is located at the second end face.

6. The distributed control assembly as recited in claim 4:

wherein the manifold block further comprises opposing first and second side faces between the first and second end faces, and a first aperture in the first side face and communicating with the first workport; and further comprising a first pressure relief valve received within the first aperture.

7. The distributed control assembly as recited in claim 6:

wherein the manifold block further comprises a second aperture in the first side face and communicating with the second workport; and further comprising a second pressure relief valve received within the second aperture.

8. The distributed control assembly as recited in claim 4 wherein the manifold block has a side face between the first and second end faces; and further comprising a check valve mounted in the side face and controlling fluid flow between the supply port and at least one of the plurality of bores.

9. The distributed control assembly as recited in claim 1 wherein at least one of the plurality of electrohydraulic valves is a pilot operated valve with a control chamber, pressure in which controls flow of fluid for one of the first and second workports.

10. The distributed control assembly as recited in claim 9 further comprising a check valve that controls pressure in the control chamber in response to pressure at the one of the first and second workports.

11. The distributed control assembly as recited in claim 1 wherein the manifold block further comprises:

a side face extending between the first and second end faces; and a manually operated emergency valve mounted in the side face and controlling fluid flow from the first workport to the return port.

12. The distributed control assembly as recited in claim 1 wherein the manifold block further comprises a second supply port communicating with the first supply port; and a second return port communicating with the first return port.

13. The distributed control assembly as recited in claim 1 wherein the manifold block further comprises a pair of walls extending on opposites sides of the controller housing.

14. A distributed control assembly for operating a hydraulically powered actuator, said distributed control assembly comprising:

a manifold block having a first end face in which is located a first supply port, a first return port, first and second valve bores, and a first workport, and having a second end face in which is located a second supply port connected to the first supply port, a second return port connected to the first return port, third and fourth valve bores, and a second workport;

a plurality of electrohydraulic valves controlling flow of fluid among the first and second workports, the first supply port and the first return port, wherein each electrohydraulic control valve is received in one of the first, second, third and fourth valve bores in the manifold block; and a controller housing containing an electronic function controller and removably mounted against the manifold block.

15. The distributed control assembly as recited in claim 14 wherein:

the manifold block further comprises a first pressure port in communication with one of the first workport and the second workport; and a first pressure sensor within the controller housing and in fluid communication with the first pressure port.

16. The distributed control assembly as recited in claim 14 wherein the manifold block further comprises a pair of exterior walls that are spaced apart and wherein the controller housing is located between the pair of exterior walls.

17. The distributed control assembly as recited in claim 14:

wherein the manifold block further comprises a side face between the first and second end faces with first aperture in the side face and communicating with the first workport; and further comprising a first pressure relief valve received within the first aperture.

18. A distributed control assembly for operating a hydraulically powered actuator, said distributed control assembly comprising:

a manifold block having a first supply port for connection to a pressurized fluid source, a first return port for connection to a fluid reservoir, first and second workports for connection to the hydraulically powered actuator, and a plurality of valve bores, the manifold block further having a pair of exterior walls that are spaced apart thereby forming a cavity there between;

a plurality of electrohydraulic valves received in the plurality of valve bores for controlling flow of fluid among the first and second workports, the first supply port and the first return port; and a controller assembly comprising an electronic function controller within a controller housing that is mounted against the manifold block within the cavity.

19. The distributed control assembly as recited in claim 18 wherein:

the manifold block further comprises a pressure port located in the cavity and connected to one of the first and second workports; and the controller assembly further comprises a first pressure sensor in communication with the pressure port of the manifold block.

20. The distributed control assembly as recited in claim 18 wherein the manifold block further comprises a second supply port connected to the first supply port, and a second return port connected to the first return port.

21. The distributed control assembly as recited in claim 18:

wherein the manifold block further comprises a side face between the first and second end faces with aperture in the side face and communicating with the first workport; and further comprising a first pressure relief valve received within the aperture.

22. The distributed control assembly as recited in claim 18:

wherein the manifold block has aperture in communication with the supply port and at least one of the plurality of bores; and further comprising a check valve received with in the aperture.

23. The distributed control assembly as recited in claim 18 wherein at least one of the plurality of electrohydraulic valves is a pilot operated valve with a control chamber, pressure in which controls flow of fluid between one of the plurality of valve bores and one of the first and second workports.

24. The distributed control assembly as recited in claim 23 further comprising a check valve that controls pressure in the control chamber in response to pressure at the one of the first and second workports.

* * * * *